United States Patent [19]

Briggs

[11] Patent Number: 4,669,790

[45] Date of Patent: Jun. 2, 1987

[54] MULTIPURPOSE CABINET

[76] Inventor: Sharon L. Briggs, 5942 Veranda Dr., Springfield, Va. 22162

[21] Appl. No.: 680,365

[22] Filed: Dec. 11, 1984

[51] Int. Cl.[4] ..... A47B 21/00

[52] U.S. Cl. ..... 312/208; 312/250; 312/293

[58] Field of Search ..... 312/194, 196, 324, 348, 312/349, 350, 208, 209, 250, 29, 21, 294, 273, 274, 292, 293, 249

[56] References Cited

U.S. PATENT DOCUMENTS

| | | | |
|---|---|---|---|
| 110,941 | 1/1871 | Vannice | 312/196 |
| 271,061 | 1/1883 | Hafgar | 312/196 |
| 408,125 | 7/1889 | Miller | 312/348 |
| 3,049,390 | 8/1963 | Wolfe | 312/196 |
| 4,345,803 | 8/1982 | Heck | 312/208 |
| 4,491,375 | 1/1985 | Ugalde | 312/250 |

*Primary Examiner*—Kenneth J. Dorner

*Assistant Examiner*—Gerald A. Anderson

*Attorney, Agent, or Firm*—William F. Frank

[57] ABSTRACT

This cabinet is designed to allow an individual to customize a piece of fine cabinet furniture for his own needs in all spectra of entertainment or business at the same time allowing for the protection of the equipment against dust and light. Thus the cabinet may be used in one configuration as a computer center with a main pull-out shelf at a height comfortable for typing; with a storage for diskettes, tapes and manuals; and, complete with a cart for a printer. It may be used for video games as well as a VCR and TV. It may be used as a utilitarian office center capable of holding a typewriter and telephone as well as various files, all of which can then be hidden from sight by closing the bifold doors. A separate rollaway cart is stored in one side of the bottom half of the cabinet and in one design is a printer cart and in the other design is a bar with cutouts to hold bottles of varying sizes.

5 Claims, 9 Drawing Figures

MULTIPURPOSE CABINET

FIELD OF INVENTION

The present invention is in the field of storage cabinets. More specifically, the invention comprises a plurality of shelves, fixed and slideable; drawers having adjustable dividers all of which combine in various configurations to provide a wall cabinet which can serve as entertainment center, a secretarial station or a computer work station.

BACKGROUND OF THE INVENTION

The increased interest in, and acquisition of, computers and all the associated equipment to maximize their inherent potential has unfortunately outsped the provision of work stations which properly correlate the arrangement of the physical components for ease of operation and ready accessibility of support materials as manuals, storage disks, paper supply, etc. Users have been faced with the problem of assembling desks, shelf units, storage drawers and the like which were generally not made up as units which can be readily and practically assembled.

The family entertainment center has progressed from just a television set to include stereo players/recorders and sound systems, video cassette recorders, video games, cassettes for recording programs and storage areas for recorded cassettes, video games and the like. Standing or hanging shelf units of proper size and strength are not readily available and generally must be used in combination with desk and drawer units.

The present cabinet has been designed with as many adjustable features as possible to allow a wide variety of equipment to be used in a comfortable and convenient fashion within a piece of fine furniture, at the same time providing this equipment with protection against dust and light. It has been engineered to make any operator feel comfortable at the station through the adjustable features which allow a CRT or television to be mounted at a height to fit his or her individual needs and prevent an unnatural head and eye position. It has been designed for a dual purpose: to act as both an entertainment and practical work station for people who have a limited amount of space in their living quarters or who would prefer to house their home and office equipment in a dust-free atmosphere within an aesthetically beautiful piece of furniture.

SUMMARY OF THE PRESENT INVENTION

A multi-purpose cabinet in the mode of fine furniture, comprising a configuration of shelves and drawers capable of housing a wide variety of equipment including varying sizes of computers, televisions, video cassette recorders, video games, typewriters, telephones and modems, books, diskettes and tapes as well as a free-standing cart mounted on casters designed to hold a printer, said cart having a sliding shelf to catch paper fed from the printer; said cabinet having bifold doors to enclose the equipment therein. A slight variation of the above comprises the identical cabinet with the cart modified slightly to hold bottles to act as a roll-around bar. A third variation of the above cabinet eliminates the rolling cart, substituting drawers and shelves for storage.

BRIEF DESCRIPTION OF THE DRAWINGS

The present invention is shown in the accompanying drawing figures which illustrate the principal concepts of the present invention and are not be be limiting in the scope of the invention.

DETAILED DESCRIPTION OF THE INVENTION

Figure 1:
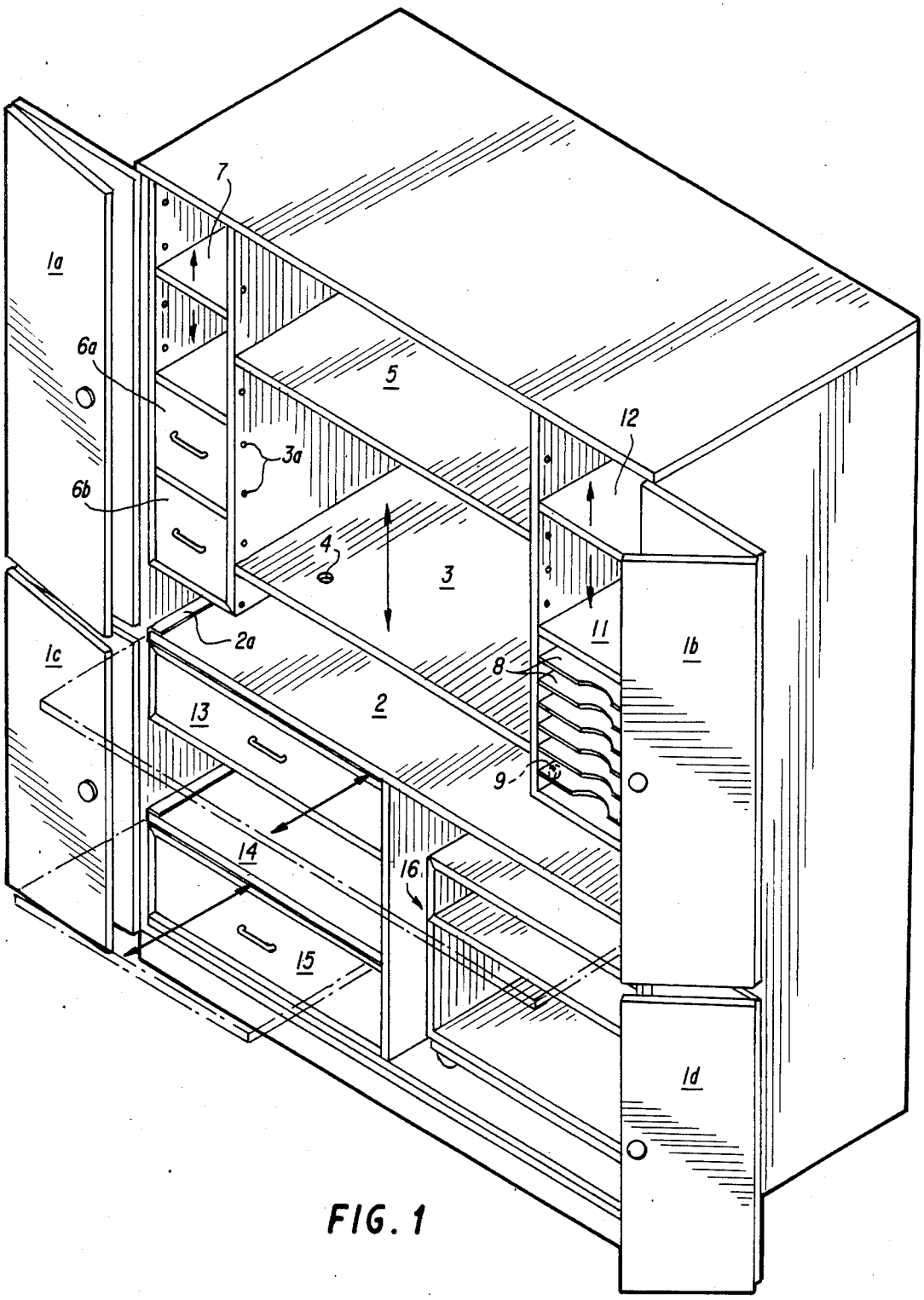
FIG. 1 is a front elevation perspective view of the present invention.

FIG. 1 shows the interior of the cabinet which will be seen to comprise a back wall joined to spaced-apart opposing side walls, top and bottom walls joining the back and side walls and a front wall composed of two pairs of bi-folding doors hingedly mounted on the front edges of the side walls. The cabinet is shown with its four bifold doors 1*a–d* open. It will be noticed that the doors fold back onto themselves to allow the cabinet to be stored in the least possible space. When closed, the doors prevent dust and light from reaching delicate equipment stored inside. The cabinet is basically designed in two sections, an upper cabinet and a lower cabinet, joined as one large piece of furniture. The top half of the cabinet may be used independently of the bottom half, and vice versa, simply by opening the doors which cover the required space.

When the doors to the upper cabinet are opened as in FIG. 1, the basic features of this section are revealed. A first shelf 2 extends the full width of the cabinet at a height which allows the seated operator's arms to hang naturally from the shoulders in a comfortable typing position. The shelf slides forward (as seen in phantom lines) to hold a computer keyboard or typewriter, providing legroom underneath. When pushed back into the cabinet along guides 2*a*, the upper doors close over the shelf and conceal the contents of the upper cabinet. The purpose of this sliding shelf, known hereinafter as the keyboard shelf, is to hold either a typewriter, sewing machine, video game control unit, computer keyboard, or like equipment at a height to allow proper posture and eliminate neck and back strain. The keyboard shelf is sufficiently deep to allow storage of virtually any typewriter and most personal computers with their keyboards.

In the event that a computer consists of components with a keyboard that detaches, and those components are too deep to be stored on the keyboard shelf in their normal configuration with the mainframe behind the keyboard, provision has been made to allow the keyboard to be kept on the keyboard shelf with the maincomponents stored on a second shelf, 3 and connected together through a first aperture 4 in the shelf. This shelf may be adjusted up to down, as shown, or removed entirely in the event that equipment mounted on the keyboard shelf is large or a computer has an attached monitor. Shelf 3 has primarily been designed to hold a CRT or television at a height adjustable to suit a person's individual needs and allow him to put the screen at his own eye level in a naturally comfortable viewing position when the screen is connected to a computer or video game or VCR. A third shelf 5 which is vertically adjustable using supports 3*a*, allows further individualization of the cabinet for storing manuals, files, etc. In case the keyboard of a computer is stored on the keyboard shelf 2 and its maincomponent on the shelf 3, then the monitor or television for this computer may be stored immediately above the maincomponents on shelf 5.

Figure 7:
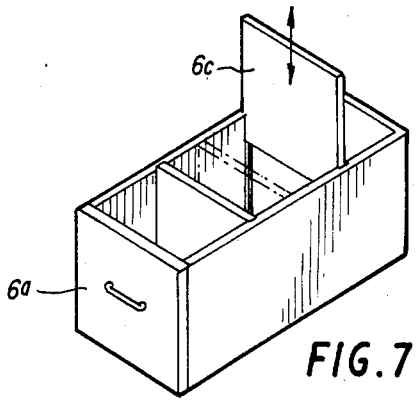
FIG. 7 is a front elevation perspective view of a component for storage of computer floppy diskettes.

On the left side of the upper cabinet, there are two drawers 6*a* and 6*b* designed to hold 5¼" computer diskettes. As seen in FIG. 7, each drawer is provided with removable verticle dividers 6*c*. These drawers can be removed entirely. Also on the left is one adjustable shelf 7 for additional miscellaneous storage.

On the right side of the upper cabinet is a compartment of removable file dividers 8 for storage of typing paper, computer folders or ongoing files. This space is also specifically designed to act as storage for a telephone and a modem connecting the telephone to the computer by removing as many file dividers as necessary for whichever telephone modem an individual has. A second aperture 9 exists in the side of the file compartment to allow cords to be threaded through to join the modem to the computer. A third aperture 10 (see FIG. 8) also exists in the rear wall of the cabinet to allow the telephone to be connected to its jack. An adjustable shelf 12 is above shelf 11 at the top of the file compartment for miscellaneous storage.

Figure 6:
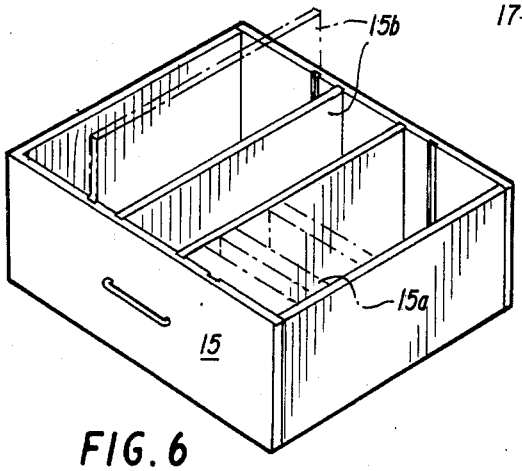
FIG. 6 is a front elevation perspective view of a component for storage of VCR tape cassettes.

When the bifold doors to the lower cabinet are opened, as seen in FIG. 1 below the keyboard shelf 2, on the left side, is a drawer 13 for the storage of office supplies, manuals, or other items. Below the drawer 13 on the left is a shelf 14 extending across half of the bottom cabinet which slides forward as seen in the phantom and is intended as a storage shelf for a VCR or video game machine but which may be adapted to an individual's needs. There is enough clearance between this sliding shelf 14 and the drawer 13 above to allow use of either top-loading or front-loading VCRs. Directly under this sliding shelf is a divided storage drawer 15 designed to hold VCR cassettes 15*a* either VHS or Beta, as well as video game cassettes or, with the dividers removed, (see FIG. 6) simply to act as miscellaneous storage.

In the bottom right half of the cabinet in FIG. 1*a* rollaway cart 16 is stored. There is enough clearance between the top surface of this cart and the keyboard shelf 2 above to hold most household-size computer printers as well as most typewriters. This cart (FIG. 2) is designed to be removed from the cabinet, rolled to wherever desired in the room, and, after use, to be stored once again within the cabinet. It is on casters 17. The cart is basically constructed as a cube and open on two opposing sides. A bottom shelf 18 is intended to hold paper to be fed into the printer up through the top surface 19 through the paper-feed aperture 20. There is a movable shelf 21 which pulls out from the printer cart to act as a paper catch which has a high lip 22 to prevent the paper from spilling over the edge. Handholds 23 are provided to allow easy movement of the cart 16.

Figure 3:
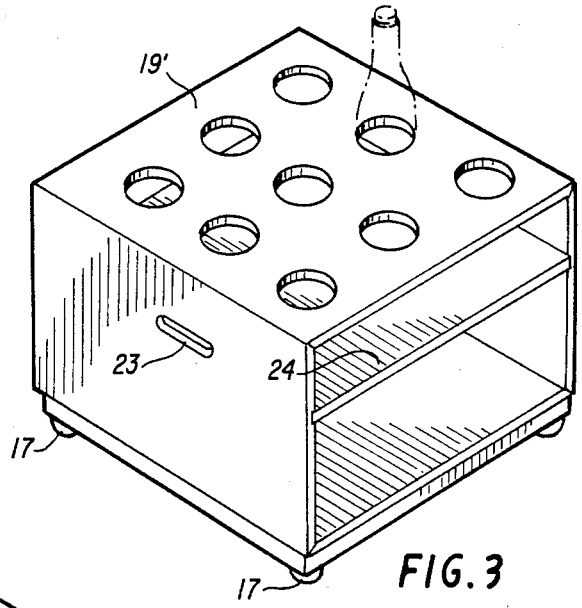
FIG. 3 is a front elevation perspective view of a modification of the component seen in FIG. 2.

FIG. 3 shows the cart in a configuration for use as a portable bar. In this instance, the former pull-out paper-catch shelf 21 is now a fixed shelf 24 and the former surface 19 of the cart now contains various cut-outs intended for bottle storage.

Figure 2:
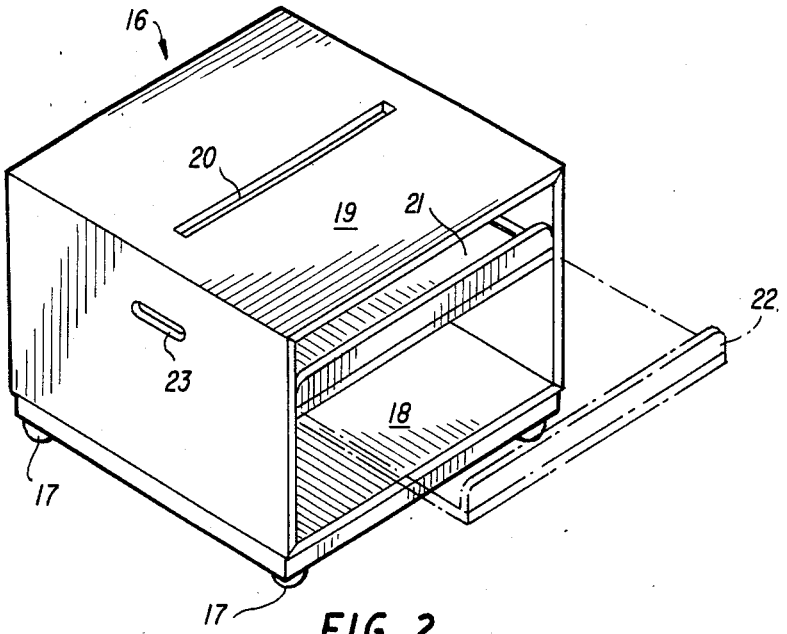
FIG. 2 is a front elevation perspective view of a removable component of the present invention.
Figure 4:
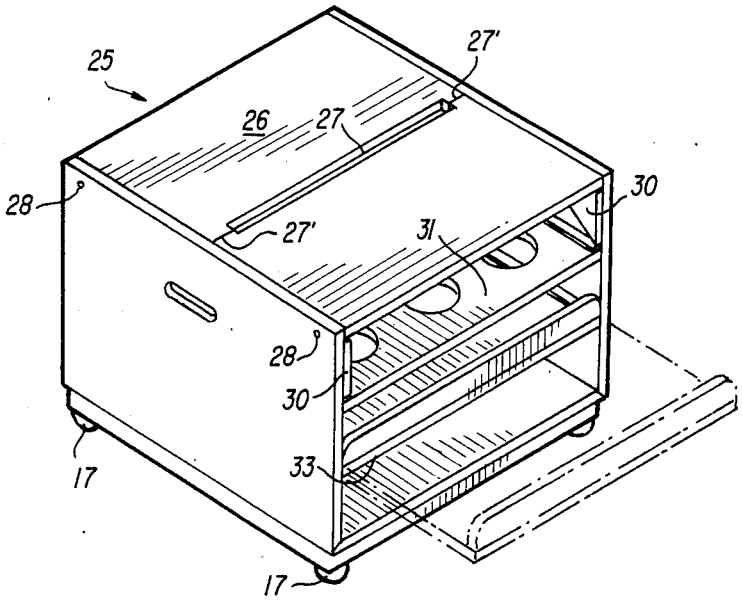
FIG. 4 is a front elevation perspective view of another embodiment of the component in FIG. 2.
Figure 5:
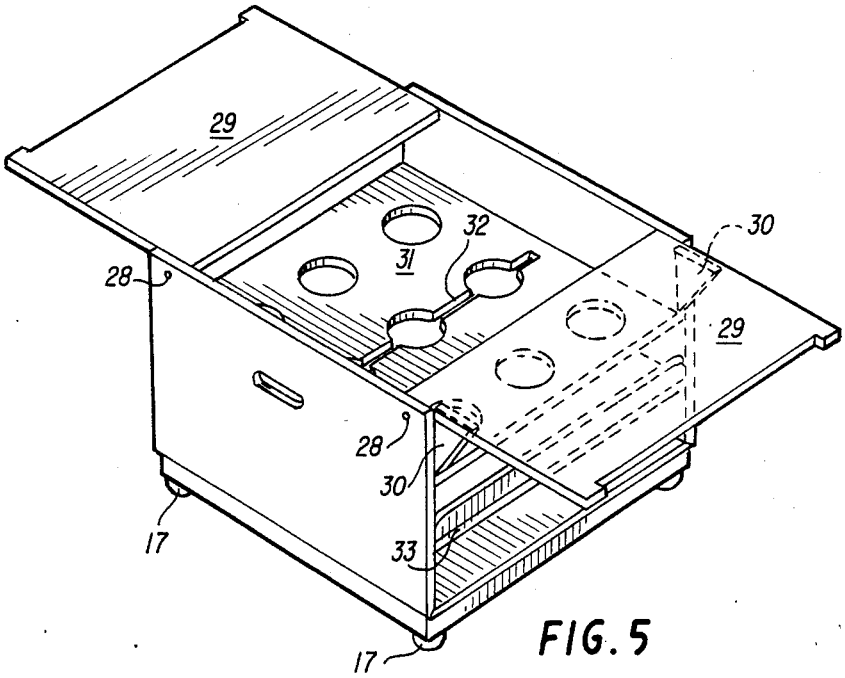
FIG. 5 is a front elevation perspective view of the embodiment seen in FIG. 4 with the top opened for an unassociated use of the component.

FIGS. 4 and 5 illustrate an additional embodiment of the cart which, in substance, combines the features seen in FIGS. 2 and 3. The top surface 26 of the cart 25 contains a paper feed aperture 27 which is longitudinally bisected by a cut 27′ which divides the top surface 26 in two. Each half can be pivoted about pins 28 to form serving surfaces 29. The so-laid out surfaces 29 rest on supports 30 which swing out in a manner similar to a gateleg table. It will be noted that the bottle-apertured shelf 31 has a paper feed aperture 32. In lieu of the slide-out shelf 33 for catching paper, the shelf 31 could be so constructed.

Figure 8:
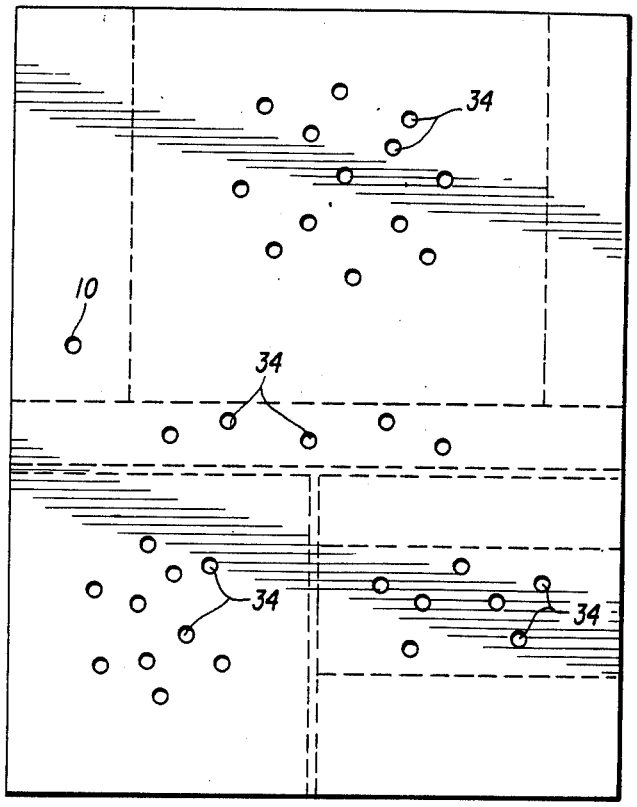
FIG. 8 is a rear elevation view of the invention seen in FIG. 1.

FIG. 8 is a view of the rear of the cabinet illustrating the ventilation and power apertures 34 in each of the compartments where machinery might be stored. These are designed so that power cords or connection cables or antennas can be threaded through the rear of the cabinet into the interior to connect the various components.

Figure 9:
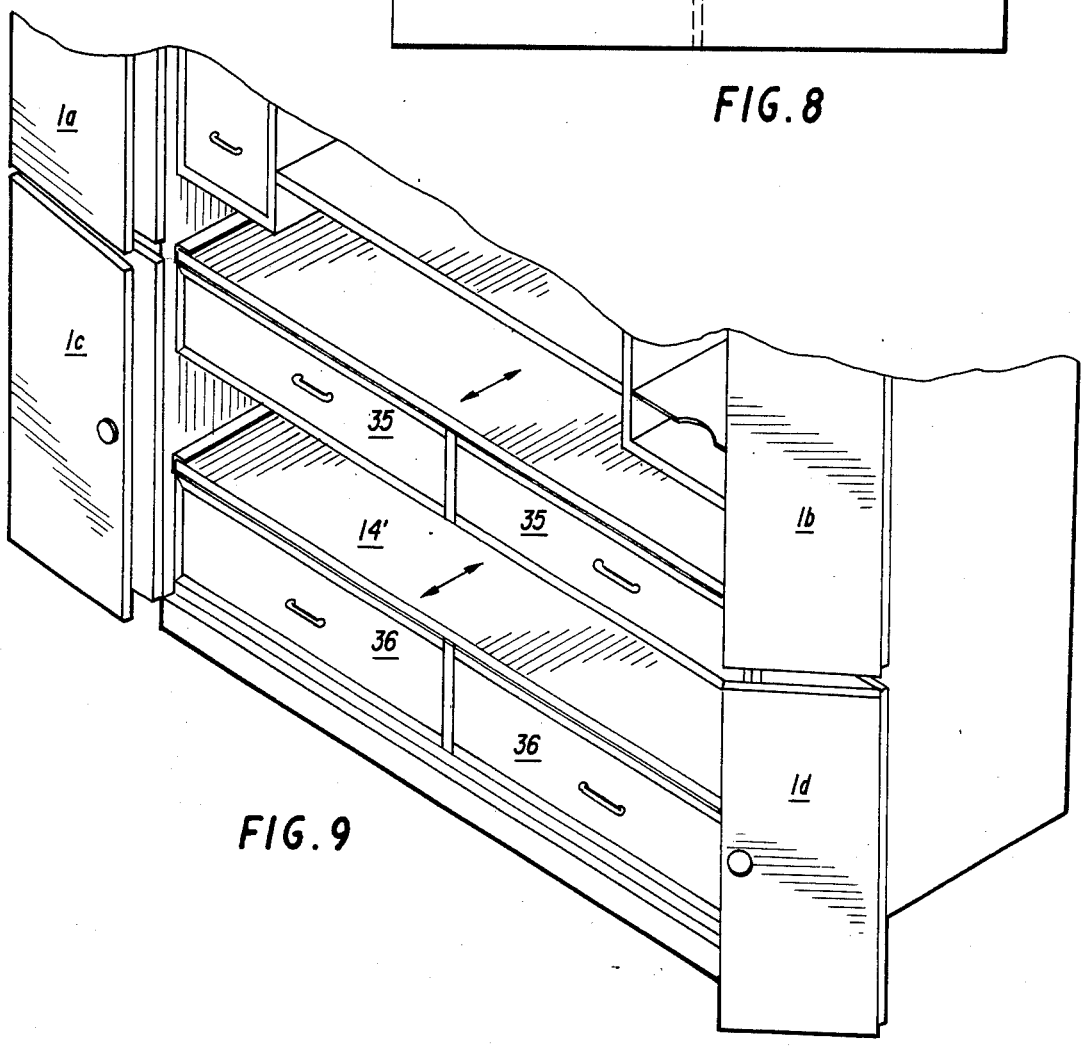
FIG. 9 is a partial frontal view of a modification of the drawer portion of the invention seen in FIG. 1.

FIG. 9 shows the interior of the bottom half of the cabinet when no printer cart is desired. In this case there are two general storage drawers 35. The VCR/video game shelf 14 is expanded to extend across the width of the cabinet and in this configuration can hold two VCRs or a VCR plus video game console, or even a printer. The shelf slides out of the cabinet, as in FIG. 1, for easy loading of video or game cassettes, and there is enough clearance for top-loading models. Underneath the sliding shelf there are now two drawers 36 to hold video or game cassettes, rather than one as before. Both of these drawers are divided as in FIG. 4, and the dividers are removable for more general storage.

It is to be noted that the cabinet illustrated in FIG. 1 can be produced in a mirror image without departing from the scope of the present invention.

What is claimed is:

1. A free-standing wall cabinet for use as a computer work station, a secretarial station or an entertainment center comprising a back wall joined to spaced apart opposing side walls and top and bottom walls joining the back and side walls, a cabinet front wall composed of two pairs of bifolding doors hingedly mounted on the front edges of said side walls, the pairs of bifolding doors dividing the cabinet vertically into an upper cabinet section and a lower cabinet section in which the upper cabinet section has a lower limit defined by a first shelf which extends across the width of the cabinet and is slidable from a rest position with in the upper cabinet section to a position extending outward from the cabinet to provide legroom for a person seated before said cabinet, said upper cabinet section further having a storage compartment on each side wall interior extending downwardly from the top wall and terminating above said first shelf, said storage compartments forming therebetween a centered open compartment having at least one adjustable shelf positioned therein to receive a a component of a machine placed on said first shelf; said lower cabinet section having its upper limit defined by said first shelf and further being divided laterally by a vertical wall which forms two compartments of substantially identical size, one compartment having a first drawer mounted just under said first shelf with a second drawer spacedly mounted from said first drawer and below and a slidable shelf mounted above said second drawer, the other compartment containing a rollabout cart for supporting a printing device on upper surface which can be removed therefrom and used to supplement the cabinet in its selected usage, said surface further having an aperture therein to feed paper to said printing device from a paper storage area within said cart, wherein said cart comprises a cube with two opposing open sides and roller means on the bottom corners of said cube, said cube further having a fixed bottom shelf to hold a supply of continuous paper for feeding upwardly through said aperture and a slidable shelf between said upper surface and said bottom shelf to receive said paper after it has passed through said printing device, and wherein said upper surface is divided in half along said aperture, each half being pivotally mounted at its exterior end on pins in the upper corners of said cube for rotation of each half upwardly and outwardly to form servicing surfaces which rest on swingable supports, said cart further having a fixed shelf mounted between said upper surface and said slidable shelf and having a plurality of circular apertures to receive bottles of liquids, said bottle-apertured shelf having a paper-feed aperture in the same vertical plane with the aperture in said upper surface.

2. The cabinet according to claim 1 wherein one of said upper cabinet storage compartments comprises an interior wall extending downwardly from said cabinet top wall and a bottom wall connecting said interior wall and one of said cabinet side walls, two removable, vertically positioned storage drawers in the lower portion of said compartment, one of said drawers resting on said bottom wall, and a plurality of vertically adjustable shelves above said drawers and extending between said cabinet side wall and said compartment inner wall.

3. The cabinet according to claim 2 wherein said other upper cabinet storage compartment comprises an interior wall extending downwardly from said cabinet top wall and a bottom wall connecting said interior wall with other of said cabinet side walls, a plurality of dividers vertically arranged in said other storage compartment in the lower portion thereof, a fixed shelf above said dividers to support a telephonic device and an aperture in the cabinet back wall covering said other storage compartment to provide access for a cable to said telephonic device.

4. The cabinet according to claim 3 wherein said dividers are removed from said storage compartment to accept a modem and said interior wall has an aperture therein to provide access for cable means interconnecting a computer keyboard on said first shelf and said modem.

5. The cabinet according to claim 1 wherein said cabinet back wall contains a plurality of openings to vent heat created by the operation of electronic devices within said cabinet.

* * * * *